US007134581B2

(12) United States Patent
Damrath et al.

(10) Patent No.: US 7,134,581 B2
(45) Date of Patent: Nov. 14, 2006

(54) APPARATUS FOR SMOOTHING SHIRTS

(75) Inventors: Joachim Damrath, Bachhagel (DE); Kathrin Redlin, Berlin (DE); Markus Spielmannleitner, Ellwangen (DE); Bodo Urich, Berlin (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/601,544

(22) Filed: Jun. 23, 2003

(65) Prior Publication Data

US 2004/0049954 A1 Mar. 18, 2004

Related U.S. Application Data

(63) Continuation of application No. PCT/EP01/14127, filed on Dec. 3, 2001.

(30) Foreign Application Priority Data

Dec. 22, 2000 (DE) ..... 100 64 321

(51) Int. Cl.
*A41H 5/02* (2006.01)

(52) U.S. Cl. ..... 223/67

(58) Field of Classification Search ..... 223/52, 223/52.1, 67, 73, 72, 74
See application file for complete search history.

(56) References Cited

U.S. PATENT DOCUMENTS 2,504,014 A * 4/1950 Forse ..... 223/52.1
2,883,092 A 4/1959 McMillan
3,184,127 A 5/1965 Smith

FOREIGN PATENT DOCUMENTS

| | | | |
|---|---|---|---|
| DE | 1069231 | * | 1/2001 |
| EP | 0 193 483 A1 | | 9/1986 |
| FR | 2 575 773 A1 | | 7/1986 |
| WO | 99/49123 | | 9/1999 |

OTHER PUBLICATIONS

Translation of EP 1,069,231.*

* cited by examiner

*Primary Examiner*—Gary L. Welch
(74) *Attorney, Agent, or Firm*—John T. Winburn; Russell W. Warnock; Craig J. Loest

(57) ABSTRACT

A device for ironing items of clothing having sleeves, especially, shirts and blouses, by an ironing dummy includes an inflatable bag placed inside the item of clothing when ironing and reaching into the cuffs of the clothing item. To be better able to smooth out the sleeves when ironing, the end of the inflatable bag in the region of the cuffs is provided with a reinforcement that fixes the end of the sleeve and exercises a longitudinal pull on the sleeve during inflation of the inflatable bag. An inner clamping mechanism is disposed inside the cuff for the fixing process.

33 Claims, 3 Drawing Sheets

APPARATUS FOR SMOOTHING SHIRTS

CROSS-REFERENCE TO RELATED APPLICATION

This application is a continuation of copending International Application No. PCT/EP01/14127, filed Dec. 3, 2001, which designated the United States and was not published in English.

BACKGROUND OF THE INVENTION

Field of the Invention

The invention relates to an apparatus for smoothing articles of clothing, particularly shirts and blouses, by an inflatable body, i.e., an ironing dummy.

A variety of devices for ironing articles of clothing by an ironing dummy are known from the prior art. European Patent Application EP 0 193 483 A1 (subsequent application of French Patent Document Registration No. 8500673, corresponding to French Patent Publication No. 2,575,773) describes a method and an ironing dummy for ironing an article of clothing. The article of clothing is placed on an inflatable bag of the ironing dummy for ironing. An airflow in the interior of the inflatable bag blows through the bag and the article of clothing, drying and smoothing the article of clothing. Because the inflatable bag also extends into the sleeves of the clothing, these are also dried. In a development of that invention, the inflatable bag extends beyond the cuffs (potentially beyond the collar as well) of the clothing. Flexible flaps are attached at these extensions on the exterior. They are, preferably, made of the same material as the inflatable bag. When the article of clothing is positioned on the ironing dummy, and the airflow is activated, then the inflatable bag and the flaps are penetrated by the air jointly and simultaneously. The airflow inflates the inflatable bag and the flaps. The inflatable bag, then, contacts the clothing from inside. The flaps, however, contact the cuffs of the clothing from the outside. Because the flaps are also penetrated by the drying air, the cuffs are dried from inside by the inflatable bag and from outside by the flaps.

When the clothing is to be removed from the ironing dummy after the drying process, the flaps must first be moved in the other direction by hand before the clothing can be taken down off the ironing dummy. Such a procedure is complicated and time-consuming. Furthermore, it is cumbersome for the sleeves of the clothing, particularly, the cuffs, to remain hanging at the flaps each time the clothing is put on or taken off, which would, undesireably, crease the freshly ironed cuffs.

Another disadvantage to the cited prior art lies in the fact that cuffs of clothing are usually buttonable and contain a placket above the cuff (in the direction of the shoulder).

Because the inflatable bag inflates during the drying process, the bag presses the placket and opens it. The disadvantage is that an open placket is dried in that shape—a shape that is undesirable for aesthetic reasons.

SUMMARY OF THE INVENTION

It is accordingly an object of the invention to provide an apparatus for smoothing shirts that overcomes the hereinafore-mentioned disadvantages of the heretofore-known devices of this general type and that provides a way in which and a device (in the form of an ironing dummy) with which the ironing result can be improved and the device, as a whole, can be made easier to handle with little expenditure.

With the foregoing and other objects in view, there is provided, in accordance with the invention, a device for smoothing articles of clothing having a cuff, including a shirt-shaped inflatable body having a flexible covering and at least one arm portion with an end and at least one stiffening connected to the flexible covering at the end, the stiffening disposed inside the cuff when the cuff is being smoothed.

With the objects of the invention in view, there is also provided a device for pressing articles of clothing having and arm portion and a cuff, including a shirt-shaped inflatable body having a flexible covering for receiving a shirt-shaped piece of clothing thereon and at least one arm portion with an end for receiving the arm portion and cuff, and at least one stiffening connected to the flexible covering adjacent the end, the stiffening disposed inside the cuff when at least one of the arm portion and the cuff is being smoothed.

It has been discovered that smoothing the cuffs is also possible by directly or indirectly stiffening the inflatable bag in the region of the ends of the sleeves. That is, the stiffening is provided only on the inside of the clothing, and, therefore, makes unnecessary the disruptive flaps beneath the cuffs (which are present in the prior art). Direct stiffening means that the inflatable bag, itself, is stiffened. In contrast, indirect stiffening means stiffening by an additional part on the inflatable bag, again, only in the sleeve region of the clothing. The advantage of these stiffenings is that they are easy to realize.

According to the invention, the stiffening can be provided either only in the region of the cuff or only between the cuff and the shoulder region of the clothing (above the cuff) or in both regions.

Such stiffening can be provided in the material of the inflatable bag. For instance, stiff materials can be incorporated in the inflatable bag. Another possibility is to soak the bag, at least at certain points, with liquids that, upon hardening, lend the bag the required stability.

When the ironing dummy functions such that an air flow from its interior dries the article of clothing, it is advantageous when the stiffening is air-permeable. That way, the drying air can also flow through the clothing in the region of the stiffening and dry it. If small holes of sufficiently small diameter are incorporated in the stiffening, the stiffening is sufficiently stable, while air is able to flow through it, but the inflatable bag cannot press through the holes and deform the clothing.

A specific type of stiffening is achieved by attaching a stiffening part on the inflatable bag. This stiffening part will be referred to hereinafter as a slotted spoon. As indicated by its name, the slotted spoon serves for stiffening the inflatable bag in the region of the placket in the clothing above the cuff and has the shape of a spoon or, more precisely, a shoehorn. A widening of the placket by the inflatable bag is no longer possible. It is also true of the slotted spoon that, given operating of the ironing dummy by a drying airflow from its interior, the slotted spoon should also be air-permeable, for instance, it should be constructed with holes. The slotted spoon, in particular, as well as the stiffening, in general, can also be realized in an air-impermeable form.

For this slotted spoon to maintain its hold on the inflatable bag, at least one of its ends can engage a strap, which can be sewn onto the inflatable bag, for example. This strap can better compensate relative movements between the slotted spoon and the inflatable bag because the slotted spoon can slide in the strap.

But, it is also possible for the slotted spoon to be attached directly to the inflatable bag at least with one end, for instance, with glue. of course, both fastening options can be combined because such a slotted spoon has two ends. The slotted spoon can be fastened, i.e., glued, to the inflatable bag on the inside or on the outside.

In accordance with another feature of the invention, the clothing has a placket adjacent the cuff and the stiffening has a portion covering the placket when the article of clothing is being smoothed.

In accordance with a further feature of the invention, the clothing has a placket adjacent the cuff and the placket has an interior and the stiffening has a portion covering the interior of the placket when the article of clothing is being smoothed.

It can be advantageous when the cuff of the clothing is held during ironing. The cuff, thereby, gains better seating and is more reliably smoothed. It is particularly practical when a clamp is formed at the slotted spoon, in either a releasable or fixed fashion. Regardless of whether the drying airflow comes from outside or inside, because the clamp grips the cuff on the outside, it is advantageous when the clamp also is air-permeable so that the drying is not impeded by parts situated on the outside. The air permeability can be accomplished by holes.

In accordance with an added feature of the invention, the stiffening has holding devices for fastening the article of clothing thereon.

In accordance with an additional feature of the invention, the stiffening has means for fastening the article of clothing thereon.

In accordance with yet another feature of the invention, the air-permeability is purposely impeded. Because the face side of the bottom end of the inflatable bag part that is located in the sleeve of the clothing plays no role in the drying process, it is expedient if none of the valuable drying air escapes from the face side while the ironing dummy is being operated with an air flow from its interior.

Frequently, the pressing force of the inflatable bag is insufficient for smoothing the cuff of the clothing to a satisfactory degree. To achieve a satisfactory result despite this, a tension mechanism can be disposed in the inflatable bag in the region of the cuff. This tension mechanism expediently has two chuck jaws that brace against one another under spring tension. Preferably, the stiffening is an internal tension mechanism and the two chuck jaws are connected to one another.

In accordance with yet a further feature of the invention, the stiffening has offset surfaces or angled surfaces for exerting traction on the article of clothing.

In accordance with a concomitant feature of the invention, the stiffening has means for exerting traction adjacent the cuff.

Other features that are considered as characteristic for the invention are set forth in the appended claims.

Although the invention is illustrated and described herein as embodied in an apparatus for smoothing shirts, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
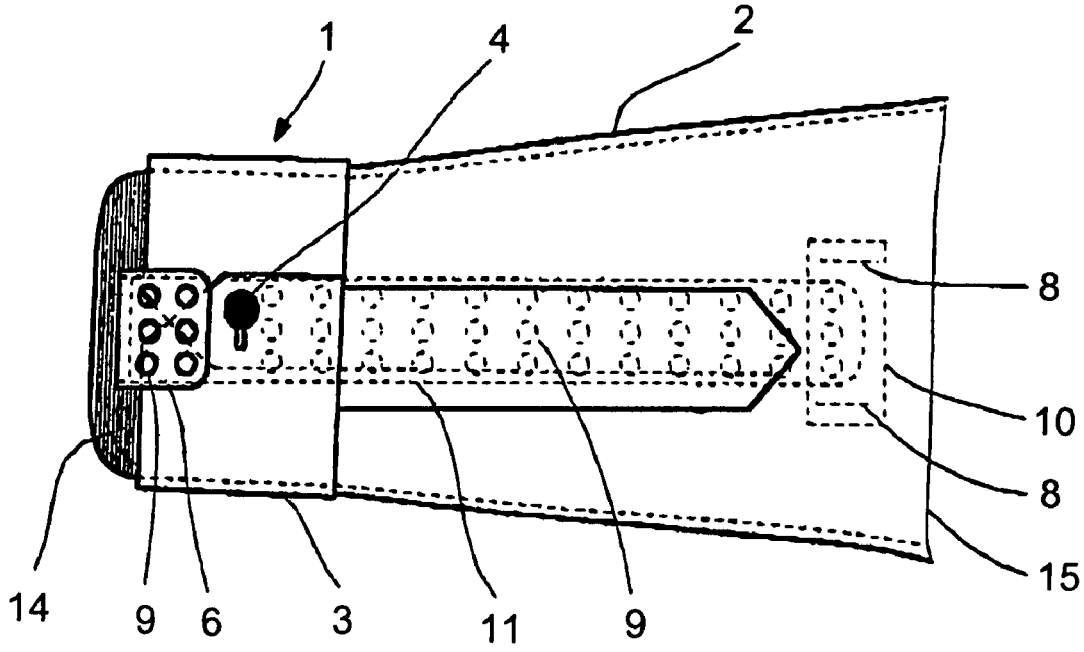
FIG. 1 is a fragmentary, elevational and partially hidden view of part of an ironing dummy according to the invention with a corresponding portion of an article of clothing and with a stiffening in the region of a cuff.

Referring now to the figures of the drawings in detail and first, particularly to FIG. 1 thereof, there is shown a stiffening of the inflatable bag 7 in the region of a buttonable cuff 3 of an article of clothing 2. This stiffening represents the function of a cuff smoother 1. The stiffening of the cuff smoother 1 has rendered it air-impermeable. For that reason, the cuff smoother 1 is provided with air holes 9 so that the airflow can also dry the cuff 3. The bottom end of the inflatable bag (corresponding to the left side of the FIG. 1) includes an air-impermeable region 14 so that valuable drying air cannot penetrate outside unused. After the clothing 2 is placed on the ironing dummy, and the cuff 3 is buttoned, the airflow for the inflatable bag 7 can be switched on. Because the cuff smoother 1 is provided with airholes, the drying air penetrates these holes to the outside and dries and smoothes the cuff 3. The stiffening is defined with respect to the remaining region of the inflatable bag 7 and the clothing 2 by a boundary line 13. This region of the sleeve 15 is characterized by a placket in the material. The overlapping material in the region of the placket is also referred to in the industry as the overlap 21. The underlying material is called the underlap 22. The narrow, tapering (to the right of FIG. 1) strip of material on the exterior is referred to as trimming 20. In the region 12, at least one double layer of material emerges. Given operating of the ironing dummy, the air in the inflatable bag 7 presses the region 12 apart. The overlap 21 and the underlap 22 experience movement in an expansion direction 19. When the material of the clothing 2 is not stiff enough in relation to the pressure in the inflatable bag 7, an unintentional deformation of the clothing 2 can occur in the region 12.

Figure 2:
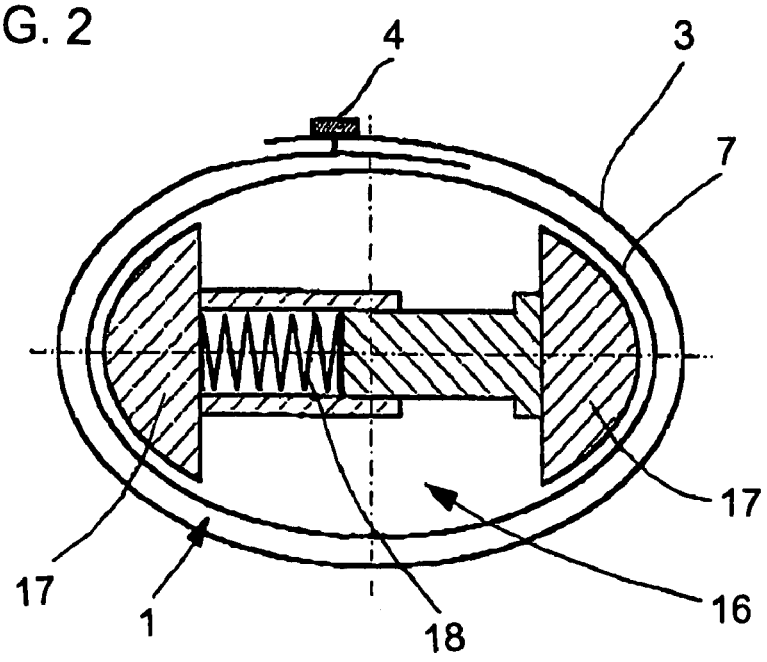
FIG. 2 is a fragmentary, elevational and partially hidden view of the dummy of FIG. 1 with an additional stiffening in the form of a slotted spoon in the region above the cuff.
Figure 5:
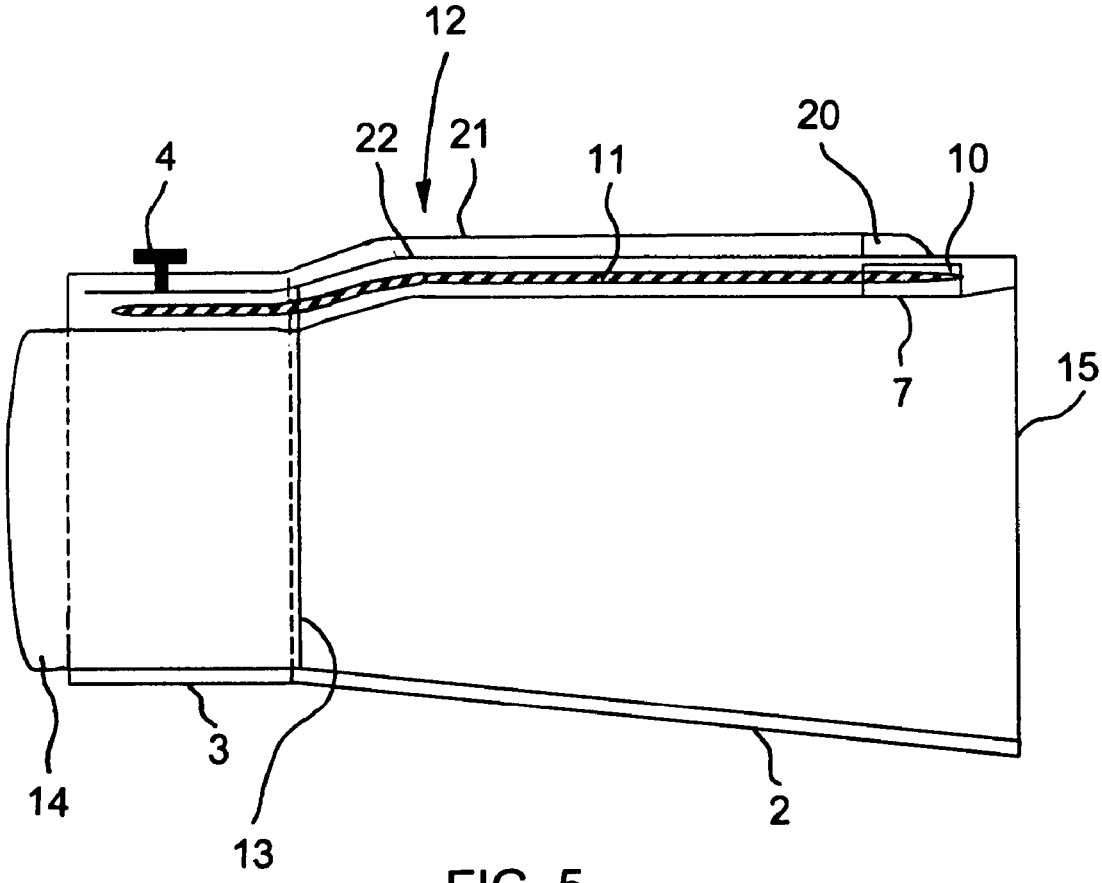
FIG. 5 is a cross-sectional view of the dummy of FIG. 2 along section line V—V.

FIGS. 2 and 5 represent a remedy for the deformation in the region of the overlap 21 and underlap 22. A stiffening in the form of a slotted spoon 11 is utilized in addition to the cuff smoother 1. This slotted spoon 11 is held by a strap 10 at one end (to the right of FIGS. 2 and 5). This strap 10 is fastened to the inflatable bag 7 with seams 8. In this exemplifying embodiment, the other end of the slotted spoon 11 is fastened to the inflatable bag 7 in the vicinity of the cuff 3.

Pressure is exerted on the overlap 21 and underlap 22 by the stiffening with the aid of the slotted spoon 11; however, there is no notable widening of the placket because the slotted spoon 11 presses flush and, due to its rigidity, allows hardly any arching.

Figure 3:
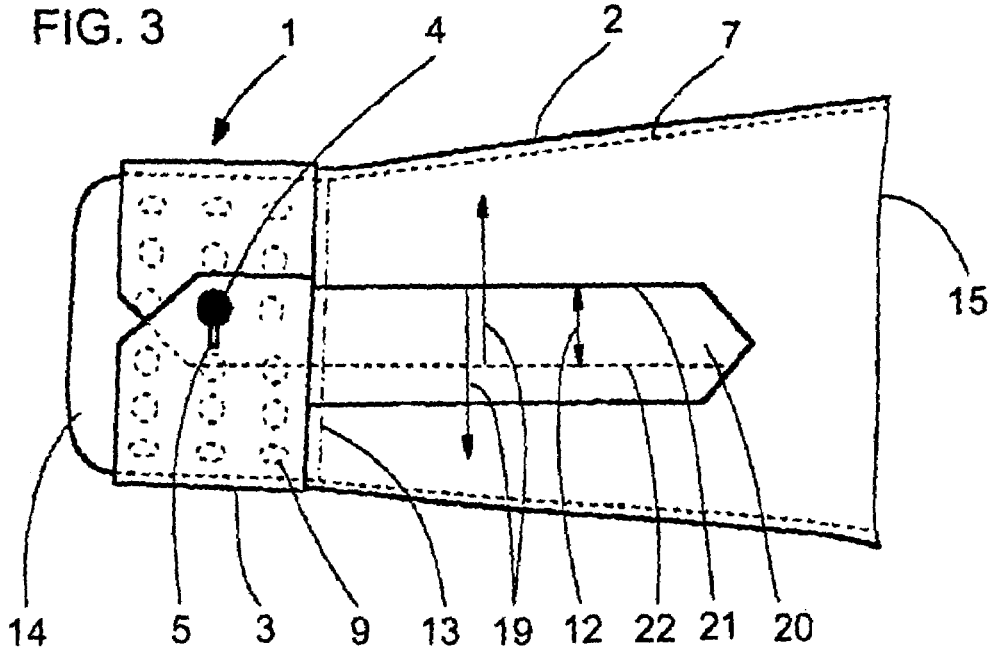
FIG. 3 a fragmentary, elevational and partially hidden view of the dummy of FIG. 2 with a clamp formed on the slotted spoon.

FIG. 3 represents another development of the invention. The slotted spoon 11 is provided with air holes 9 so that it does not impede the drying of the clothing 2 given a drying airflow from inside the inflatable bag 7. In addition, the slotted spoon 11 is provided with a clamp 6. This clamp 6 is formed on the slotted spoon in a fixed manner. Because the slotted spoon 11 is disposed between the inflatable bag 7 and the clothing 2, and because the clamp 6 surrounds the cuff 3, the cuff 3 is held and shaped by the clamp 6. The clamp 6 is also provided with air holes 9 for better air permeability.

In the exemplifying embodiment of FIG. 3, the cuff smoother 1 is no longer characterized by an additional stiffening in the region of the cuff 3. But it is still possible to speak of a cuff smoother 1, because the inflated bag 7 still exerts a stressing effect and, thus, a smoothing effect. In this example, the inflatable bag 7 is wholly air-permeable in the region of the clothing 2. For this reason, for purposes of illustration, the air-impermeable region 14 at the face side of the inflatable bag 7 has been highlighted by hatching, in contrast to FIGS. 1 and 2.

Figure 4:
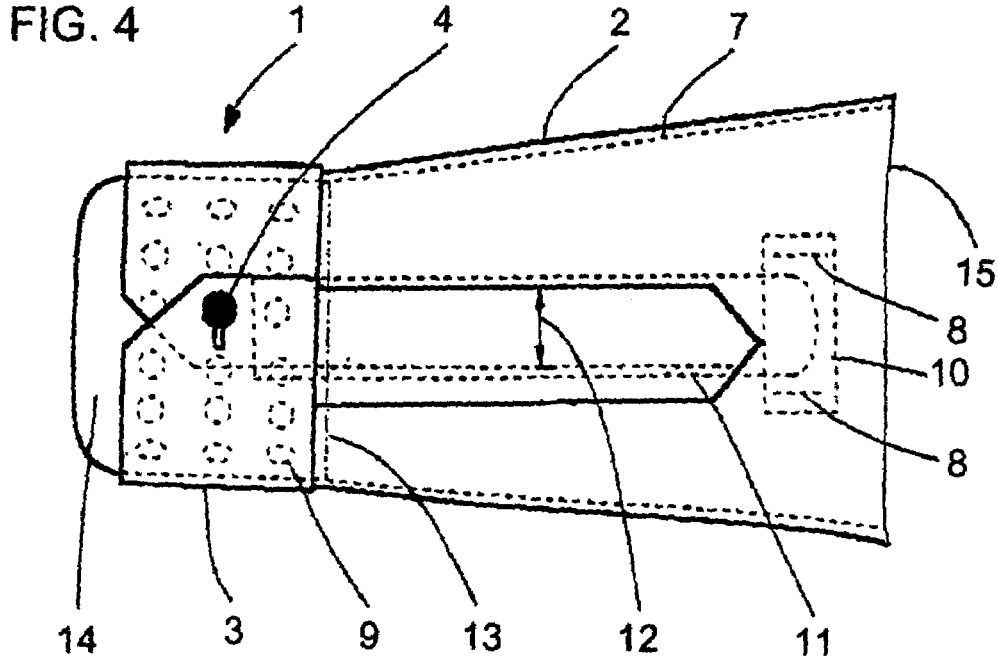
FIG. 4 is a cross-sectional view of the dummy of FIG. 1 through a region of a cuff, the dummy having a tension mechanism for the cuff.

The cross-section represented in FIG. 4 illustrates one possible tension mechanism 16 for the cuff 3 of an article of clothing 2. For purposes of clarity, the ellipsoidal lines in FIG. 4 have been set apart clearly so that they do not overlap. In reality, they are situated immediately adjacent one another. The cuff 3 is closed with the aid of a button 4. Further in is the inflatable bag 7. Two chuck jaws 17 press the inflatable bag 7 from inside. This pressing force comes from a spring 18, which presses the guided chuck jaws 17 apart. The chuck jaws 17 do not fill the entire volume of the cuff 3, but complete filling of the volume is not necessary for a satisfactory smoothing result. Namely, when the chuck jaws 17 tense the ellipse longitudinally in the indicated manner, the airflow in the inflatable bag 7 can, nevertheless, produce a slight arcing of the cuff 3, which generates a notable tangential tensioning effect.

The chuck jaws 17 can be constructed with non-illustrated air holes 9 so that they do not block access by a drying airflow to the cuff 3 (in case the airflow comes from inside the inflatable bag).

For easier changing of the article of clothing 2 in the region of the cuff 3, the tension mechanism 16 need only be compressed using the fingers of one hand.

The chuck jaws 17 are connected only to the inflatable bag and are, therefore, optimally lightweight. With the inflation of the bag 7, the arm portions of the bag 7 are also stressed longitudinally so that the chuck jaws 17 are pressed outward, and the sleeve 15 of the clothing 2, which is attached to the chuck jaws, is drawn outward. The sleeve of the clothing 2 that is to be smoothed can, thus, be drawn out by the air pressure in the inflatable bag 7, thereby improving the smoothing result in this region with little expenditure. The configuration is advantageous because expensive pulling devices, which take up additional space and interfere with handling, are rendered unnecessary.

To increase the traction effect of the chuck jaws 17 on the sleeve of the clothing, the exterior surface of the chuck jaws 17 can be provided with offsets or inclined surfaces so that the cross-section of the body formed by the chuck jaws 17 decreases in the outward direction. Because the cross-section of a sleeve 15 usually decreases in the outward direction, the chuck jaws 17 can, thus, exert a stronger longitudinal pull on the sleeve; that is, the tensile force with which the chuck jaws 17 are pushed apart can be lower. The stress on the button when the cuffs 3 are stressed from inside while in the buttoned condition can, thus, be reduced. This cross-sectional enlargement can engage particularly well at points where seams run transverse to the intended pulling direction, as is the case at the sleeve end, where the cuff 3 is sewn on.

An elastic body such as a foam or foam rubber body can also be utilized for pushing the two chuck jaws 17 apart.

We claim:

1. A device for smoothing articles of clothing having a cuff, comprising:

a shirt-shaped inflatable body having a flexible covering and at least one arm portion with an end, wherein the flexible covering is expandable for smoothing the article of clothing; and at least one stiffening member connected to said flexible covering at said end and restricting expansion of the flexible covering near the cuff, said stiffening member disposed inside the cuff when the cuff is being smoothed.

2. The device according to claim 1, wherein:

the clothing has a placket adjacent the cuff; and said stiffening member has a portion covering said placket when the article of clothing is being smoothed.

3. The device according to claim 1, wherein:

the clothing has a placket adjacent the cuff and the placket has an interior; and said stiffening member has a portion covering the interior of said placket when the article of clothing is being smoothed.

4. The device according to claim 1, wherein said stiffening member has holding devices for fastening the article of clothing thereon.

5. The device according to claim 1, wherein said stiffening member has means for fastening the article of clothing thereon.

6. The device according to claim 1, wherein said stiffening member has an internal tension mechanism.

7. The device according to claim 1, wherein said stiffening member has offset surfaces or angled surfaces for exerting traction on the article of clothing.

8. The device according to claim 1, wherein said stiffening member has means for exerting traction adjacent the cuff.

9. The device according to claim 1, wherein said stiffening member is air-permeable.

10. The device according to claim 1, wherein the stiffening member is made from a substantially non-expandable material.

11. The device according to claim 1, wherein the stiffening member is made from a substantially rigid material.

12. The device according to claim 1, wherein the stiffening member defines multiple air holes permitting air to flow from the inflatable body and toward the cuff.

13. The device according to claim 1, wherein the stiffening member includes an air impermeable region near the end of the arm portion.

14. A device for smoothing articles of clothing having a cuff, comprising:

a shirt-shaped inflatable body having a flexible covering and at least one arm portion with an end;

at least one stiffening connected to said flexible covering at said end, said stiffening disposed inside the cuff when the cuff is being smoothed;

wherein said stiffening has an internal tension mechanism; and wherein said tension mechanism has two chuck jaws bracing against one another.

15. The device according to claim 14, wherein said two chuck jaws are connected to one another.

16. A device for pressing articles of clothing having a sleeve and a cuff, comprising:

a shirt-shaped inflatable body having:

a flexible covering for receiving a shirt-shaped piece of clothing thereon; and at least one arm portion with an end for receiving the sleeve and cuff; and at least one stiffening member connected to said flexible covering adjacent said end and restricting expansion of the flexible covering near the cuff, said stiffening member disposed inside the cuff when at least one of the sleeve and the cuff is being smoothed.

17. The device according to claim 16, wherein:

the clothing has a placket adjacent the cuff; and said stiffening member has a portion covering said placket when the article of clothing is being smoothed.

18. The device according to claim 16, wherein:

the clothing has a placket adjacent the cuff and the placket has an interior; and said stiffening member has a portion covering the interior of said placket when the article of clothing is being smoothed.

19. The device according to claim 16, wherein said stiffening member has holding devices for fastening the article of clothing thereon.

20. The device according to claim 16, wherein said stiffening member has means for fastening the article of clothing thereon.

21. The device according to claim 16, wherein said stiffening member has an internal tension mechanism.

22. The device according to claim 16, wherein said stiffening member has offset surfaces or angled surfaces for exerting traction on the article of clothing.

23. The device according to claim 16, wherein said stiffening member has means for exerting traction adjacent the cuff.

24. The device according to claim 16, wherein said stiffening member is air-permeable.

25. A device for pressing articles of clothing having and arm portion and a cuff, comprising:

a shirt-shaped inflatable body having:

a flexible covering for receiving a shirt-shaped piece of clothing thereon; and at least one arm portion with an end for receiving the arm portion and cuff;

at least one stiffening connected to said flexible covering adjacent said end, said stiffening disposed inside the cuff when at least one of the arm portion and the cuff is being smoothed;

wherein said stiffening has an internal tension mechanism; and wherein said tension mechanism has two chuck jaws bracing against one another.

26. The device according to claim 25, wherein said two chuck jaws are connected to one another.

27. A device for smoothing articles of clothing having a sleeve and a cuff, comprising:

a shirt-shaped inflatable body having a flexible covering and at least one arm portion with an end, the arm portion including:

a first portion being expandable to engage the sleeve when the clothing is being smoothed; and a second portion being less expandable than the first portion, the second portion being disposed inside the cuff when the clothing is being smoothed.

28. The device according to claim 27, wherein the second portion is made from a substantially rigid material.

29. The device according to claim 27, wherein the second portion defines multiple air holes permitting air to flow from the inflatable body and toward the cuff.

30. The device according to claim 27, wherein the second portion includes an air impermeable region near the end of the arm portion.

31. The device according to claim 27, further comprising a third portion extending axially from the second portion along the arm portion, the sleeve including a placket and the third portion extending adjacent the placket inside the sleeve and restricting expansion of the first portion near the placket when the clothing is being smoothed.

32. The device according to claim 31, wherein the third portion is made from a substantially rigid material.

33. The device according to claim 31, wherein the third portion defines multiple air holes permitting air to flow from the inflatable body and toward the placket.

* * * * *